US007677670B2

(12) United States Patent
Nordstrom et al.

(10) Patent No.: US 7,677,670 B2
(45) Date of Patent: Mar. 16, 2010

(54) PATIENT CHAIR

(75) Inventors: Carl G. Nordstrom, Lake Oswego, OR (US); Edward R. Jacobs, Salem, OR (US); Mathew H. Parlier, Sheridan, OR (US); Craig J. Beard, McMinnville, OR (US); Kenneth E. Mattocks, Newberg, OR (US); Christopher C. Stone, Newberg, OR (US)

(73) Assignee: A-dec, Inc., Newberg, OR (US)

( * ) Notice: Subject to any disclaimer, the term of this patent is extended or adjusted under 35 U.S.C. 154(b) by 0 days.

(21) Appl. No.: 11/982,891

(22) Filed: Nov. 5, 2007

(65) Prior Publication Data

US 2008/0067852 A1 Mar. 20, 2008

Related U.S. Application Data

(63) Continuation of application No. 10/855,031, filed on May 26, 2004, now Pat. No. 7,290,836.

(60) Provisional application No. 60/498,918, filed on Aug. 28, 2003.

(51) Int. Cl.
*A47C 7/40* (2006.01)

(52) U.S. Cl. ..... 297/452.36; 297/452.33

(58) Field of Classification Search ..... 297/452.14, 297/452.31, 452.32, 452.33, 452.36, 452.5, 297/452.61, 452.65, 410
See application file for complete search history.

(56) References Cited

U.S. PATENT DOCUMENTS 1,210,223 A * 12/1916 Silbert ..... 297/452.31
1,685,599 A 9/1928 Fletcher
2,172,063 A 9/1939 Hara
2,278,890 A 4/1942 May
2,449,385 A 9/1948 Johnson et al.
2,466,553 A * 4/1949 McDonald, Jr. ..... 297/404
2,832,397 A 4/1958 Premo (Continued)

FOREIGN PATENT DOCUMENTS

DE 3125312 1/1983

(Continued)

OTHER PUBLICATIONS

New Scandinavian Technology.

(Continued)

*Primary Examiner*—Peter R. Brown
(74) *Attorney, Agent, or Firm*—Klarquist Sparkman, LLP

(57) ABSTRACT

A back for a patient chair with which a patient may be moved from a generally upright sitting position to a generally supine position comprises a back shell and a cushion. The back shell has a front surface, a back surface, a top, a bottom, opposed first and second outer sides, a central section extending longitudinally from a region adjacent the top to a region adjacent the bottom and opposed side sections extending laterally outwardly from the central section toward the first and second outer sides. The cushion is attached to the back shell. The central section of the back shell comprises a plurality of stiffening elements that extend longitudinally of the back shell. A patient chair including the back is also described.

23 Claims, 4 Drawing Sheets

U.S. PATENT DOCUMENTS

| | | | | |
|---|---|---|---|---|
| 2,985,228 | A | | 5/1961 | Golden |
| 3,172,699 | A | | 3/1965 | Naughton |
| 3,177,036 | A | | 4/1965 | Halter |
| 3,454,303 | A | * | 7/1969 | Dangauthier ..... 297/396 |
| 3,596,982 | A | | 8/1971 | Grams |
| 3,713,697 | A | | 1/1973 | Koepke |
| 3,722,950 | A | | 3/1973 | Harnick |
| 3,729,227 | A | | 4/1973 | Ohta |
| 3,819,232 | A | | 6/1974 | Wagner |
| 3,860,286 | A | | 1/1975 | Rasmussen |
| 3,866,973 | A | | 2/1975 | Heubeck |
| 3,874,728 | A | | 4/1975 | Weiland |
| 3,968,990 | A | | 7/1976 | Heubeck |
| 4,000,925 | A | | 1/1977 | Doerr et al. |
| 4,007,962 | A | | 2/1977 | Müller-Deisig |
| 4,032,190 | A | | 6/1977 | Müller-Deisig et al. |
| 4,099,774 | A | | 7/1978 | Sandham |
| RE29,811 | E | | 10/1978 | Norris |
| D260,703 | S | | 9/1981 | Pearson |
| 4,368,917 | A | * | 1/1983 | Urai ..... 297/452.54 |
| D268,149 | S | | 3/1983 | Case |
| 4,377,308 | A | | 3/1983 | Pisanu |
| 4,500,137 | A | | 2/1985 | Morehouse |
| 4,556,254 | A | | 12/1985 | Roberts |
| 4,557,521 | A | | 12/1985 | Lange |
| 4,639,042 | A | | 1/1987 | Lange |
| 4,657,297 | A | * | 4/1987 | Ishibashi ..... 296/63 |
| 4,712,835 | A | | 12/1987 | Völkle |
| 4,836,609 | A | | 6/1989 | Hill |
| 4,856,845 | A | * | 8/1989 | Massonnet ..... 297/286 |
| 4,856,846 | A | * | 8/1989 | Lohmeyer ..... 297/285 |
| 4,929,023 | A | | 5/1990 | Rasmussen |
| 5,007,678 | A | | 4/1991 | DeKraker |
| D333,736 | S | | 3/1993 | Nordstrom |
| 5,190,349 | A | | 3/1993 | Austin, Jr. et al. |
| 5,267,778 | A | | 12/1993 | Krebs et al. |
| 5,286,083 | A | | 2/1994 | Mattison |
| D347,946 | S | | 6/1994 | Nordstrom et al. |
| D351,742 | S | | 10/1994 | Phleps et al. |
| 5,403,067 | A | | 4/1995 | Rajaratnam |
| D361,438 | S | | 8/1995 | Spencer et al. |
| 5,489,145 | A | | 2/1996 | Van Hekken |
| 5,520,441 | A | | 5/1996 | Citton |
| 5,522,645 | A | | 6/1996 | Dahlbacka |
| 5,577,811 | A | | 11/1996 | Ogg |
| D378,961 | S | | 4/1997 | Nordstrom et al. |
| 5,624,158 | A | * | 4/1997 | Adat et al. ..... 297/230.14 |
| 5,628,546 | A | | 5/1997 | Boetzkes |
| 5,730,497 | A | * | 3/1998 | Raymond et al. ..... 297/408 |
| 5,806,930 | A | | 9/1998 | Knoblock |
| 5,836,653 | A | | 11/1998 | Albecker |
| 5,842,264 | A | | 12/1998 | Roossien et al. |
| 5,868,466 | A | * | 2/1999 | Massara et al. ..... 297/284.6 |
| 5,934,758 | A | | 8/1999 | Ritch et al. |
| 5,938,284 | A | * | 8/1999 | Coffield ..... 297/284.9 |
| 5,992,934 | A | | 11/1999 | Gehrig et al. |
| 6,027,171 | A | | 2/2000 | Partington et al. |
| 6,155,647 | A | | 12/2000 | Albecker, III |
| D462,189 | S | | 9/2002 | Brockway et al. |
| 6,447,062 | B1 | * | 9/2002 | Jaekel et al. ..... 297/284.7 |
| 6,758,522 | B2 | * | 7/2004 | Ligon et al. ..... 297/284.4 |
| 6,802,564 | B2 | | 10/2004 | Brockway et al. |
| 6,893,096 | B2 | | 5/2005 | Bonn et al. |
| 7,032,971 | B2 | | 4/2006 | Williams |
| 7,032,975 | B2 | * | 4/2006 | Hummler et al. ..... 297/409 |
| D525,443 | S | | 7/2006 | Takahashi |
| 7,216,936 | B2 | | 5/2007 | Peterson |
| 7,240,966 | B2 | | 7/2007 | Stone et al. |
| D565,315 | S | | 4/2008 | Nielsen |
| 2003/0071503 | A1 | | 4/2003 | Brockway et al. |
| 2005/0127724 | A1 | | 6/2005 | Irwin et al. |

FOREIGN PATENT DOCUMENTS

| | | |
|---|---|---|
| DE | 3710205 | 10/1987 |
| GB | 1377666 | 12/1974 |
| JP | 50-44068 | 4/1975 |
| JP | 58109051 | 6/1983 |
| JP | 63130065 | 6/1988 |

OTHER PUBLICATIONS

√Product Literature, A-dec Inc. "Experience A-DEC 500," 12 pp. (2004).

Notice of Reasons for Rejection, dated Nov. 18, 2009, issued in co-pending Japan Patent Application JP-2004-248036, filed Aug. 27, 2004. (English translation also provided).

Notice of Allowance, dated Dec. 14, 2009, issued in co-pending U.S. Appl. No. 29/342,972, filed Sep. 3, 2009.

* cited by examiner

FIG. 8
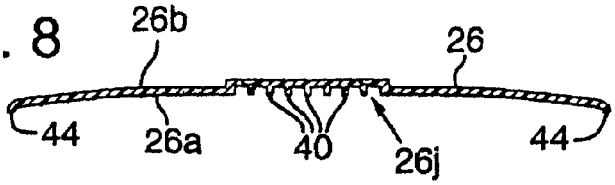
FIG. 9
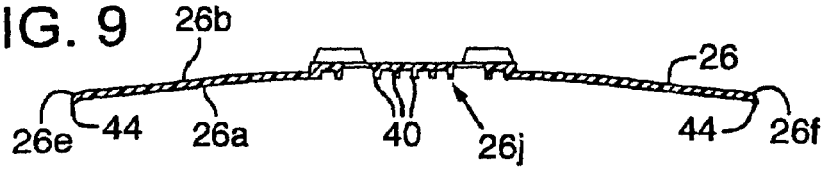
FIG. 10
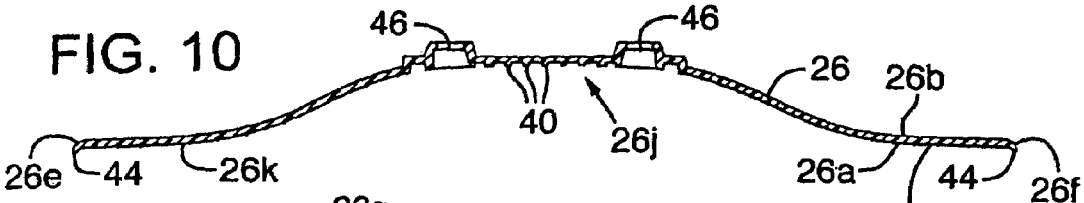
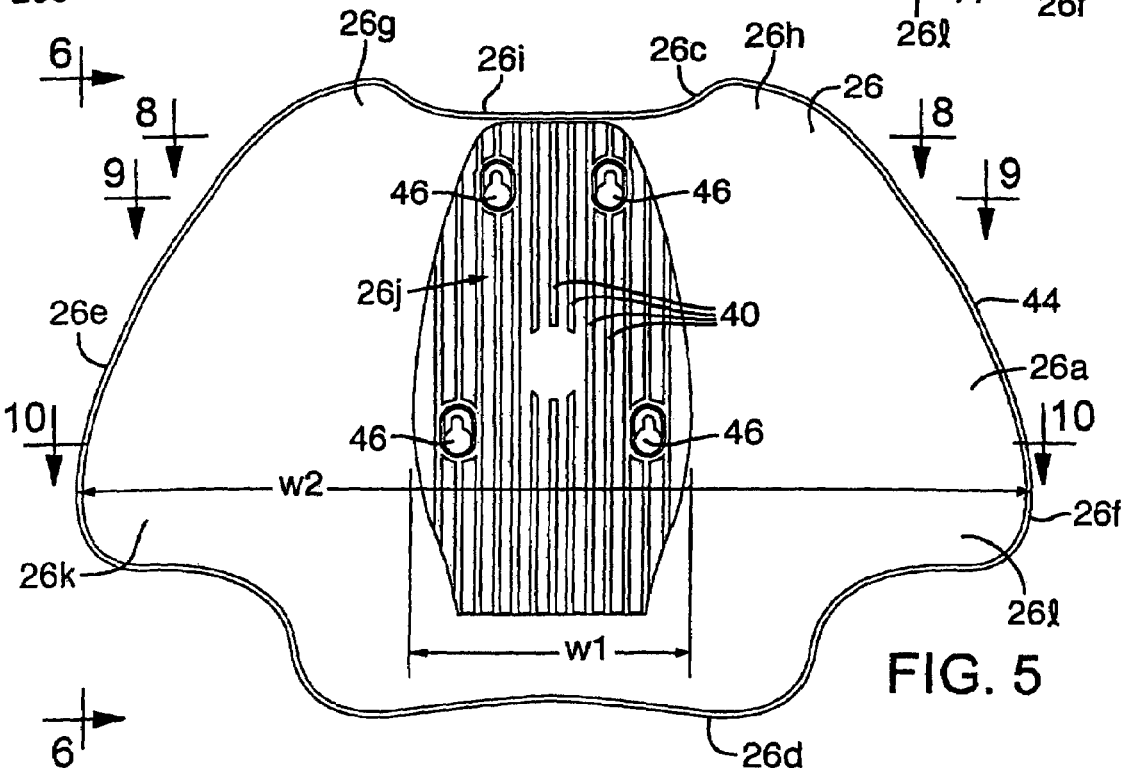
FIG. 5

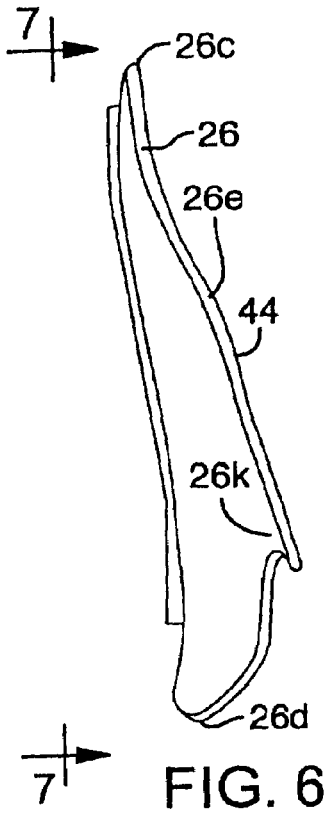
FIG. 6
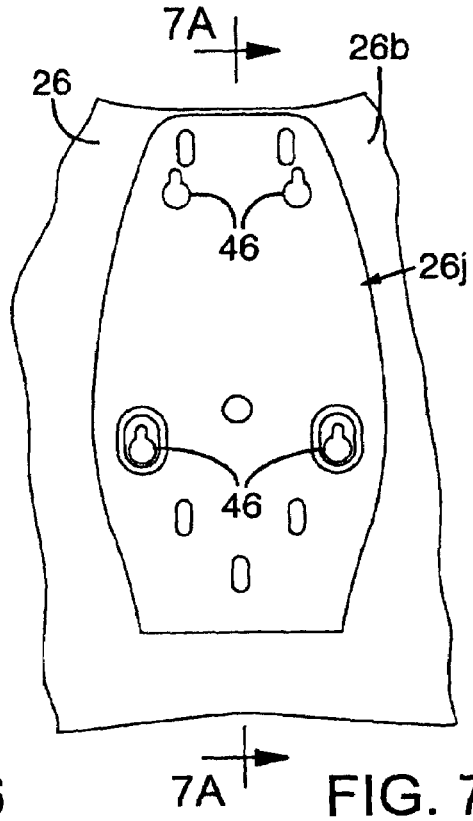
FIG. 7
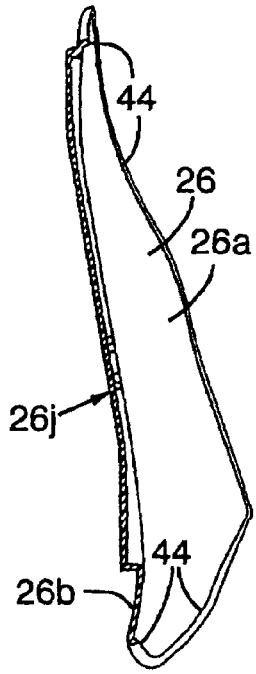
FIG. 7A
FIG. 11
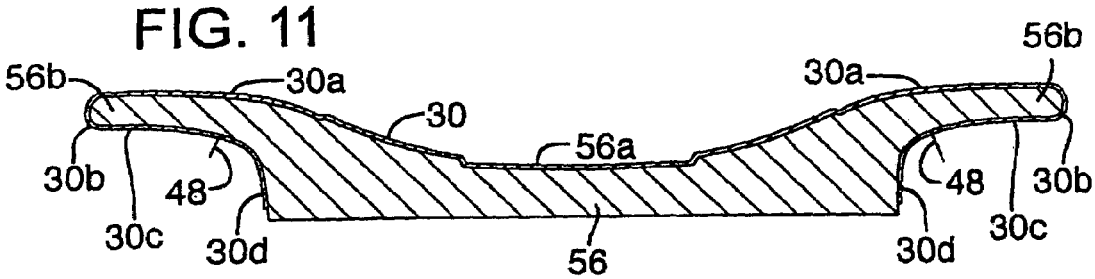
FIG. 12
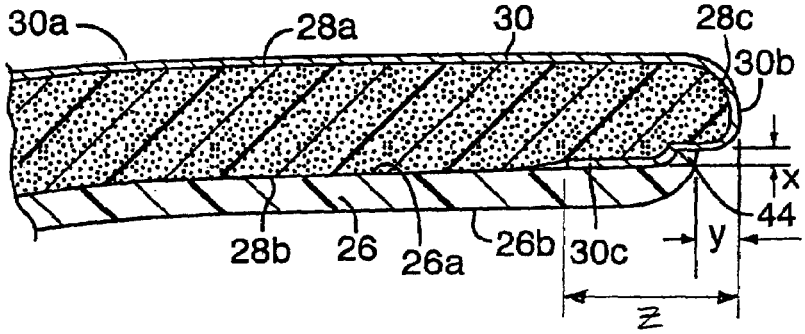

PATIENT CHAIR

CROSS REFERENCE TO RELATED APPLICATION

The present application is a continuation of U.S. patent application Ser. No. 10/855,031, now U.S. Pat. No. 7,290,836, filed May 26, 2004, which claims the benefit of Provisional Patent Application No. 60/498,918, filed Aug. 28, 2003, each of which are incorporated herein by reference.

FIELD

This application relates to patient chairs, and more particularly to a chair back which is comfortable for the patient and efficient for the operator.

BACKGROUND

Modern dental chairs include mechanism for raising and lowering the chair and tilting the back of the chair. The patient generally enters the chair when the chair is positioned with the back upright and with the seat elevated to permit comfortable entry. After the patient sits in the chair, the dentist or technician (hereinafter operator) operates the chair to move the patient into a position selected by the operator which is most convenient for the procedure to be undertaken. For many procedures, the chair back is tilted so that the patient assumes a more supine position.

Patient comfort is an important consideration. The chair should be configured so that the patient is comfortable irrespective of the chair position. Another important design consideration is that the operating position for the operator should be as convenient and efficient as possible for the operator.

In modern dentistry, the operator, whether it is a dentist or assistant, often will sit on a stool adjacent the back of the dental chair and the most convenient position to have the patient in is where the patient's head is as close to the operator's lap as possible. Thus it is helpful if the chair back is as thin as possible so that the operator's legs may be positioned under the back of the chair and minimal chair back thickness separates the operator's legs from the supine patient.

SUMMARY

Described below are embodiments of a back for a patient chair that addresses problems of conventional backs, as well as a patient chair that includes the new back.

According to one embodiment, a back for a patient chair with which a patient may be moved from a generally upright sitting position to a generally supine position, comprises a back shell and a cushion. The back shell has a front surface, a back surface, a top, a bottom, opposed first and second outer sides, a central section extending longitudinally from a region adjacent the top to a region adjacent the bottom and opposed side sections extending laterally outwardly from the central section toward the first and second outer sides. The cushion is attached to the back shell. The central section comprises a plurality of stiffening elements that extend longitudinally of the back shell.

The side sections can have sufficient flexural stiffness to support portions of a patient in a supine position and to allow deflection from a selected normal position of a side section in a direction of a force component applied substantially perpendicular to the front surface by application of the force component on the side section and to return the side section to the normal position on release of such force.

The back shell can comprise of molded plastic having a flexibility in a side section such that the side section may be flexed a distance of about 0.5 inch by a force of about 30 pounds imposed thereon. The central section can be formed in a gentle S-shape to conform generally to a patient's spine.

The stiffening elements can extend a major portion of the distance between the top and bottom of the back shell.

The back can also comprise opposing first and second scapula support sections adjacent the top, and a depressed center top-section adjacent the top and disposed between the scapula support sections, such that the top-section is configured to allow positioning of a portion of a headrest between the scapula support sections.

The back shell can have an outer peripheral edge of a selected outline, and the cushion can comprise a resilient cushion material, an outer edge margin contour substantially paralleling the outer peripheral edge of the back shell, and a layer of upholstery material overlying the cushion material. The front surface of the back shell can have a selected topographic contour, and the cushion material can be pre-formed to substantially complement the topographic contour. The upholstery material can be pre-formed to complement the shape of the front surface and the outer marginal edge of the cushion material.

According to another embodiment, a back for a patient chair with which a patient may be moved from a generally upright sitting position to a generally supine position comprises a back shell, a headrest receiving area and a cushion adjoining the back shell. The back has a front surface, a back surface, a top, a bottom, opposed first and second outer sides, a central section extending longitudinally from a region adjacent the top to a region adjacent the bottom and opposed side sections extending laterally outwardly from the central section toward the first and second outer sides, opposing first and second scapula support extension sections adjacent and extending longitudinally beyond adjacent portions of the top. The headrest receiving area is defined by each of the first and second scapula support extension sections and a depressed portion of the top between the scapula support extension sections. The headrest receiving area is configured to receive a headrest retractably mounted to the back when the headrest is retracted into a retracted position with a lower edge of the headrest contacting or overlapping the depressed portion of the top.

The central section can be formed in a gentle S-shape to conform generally to a patient's spine. The back can comprise a plurality of stiffening elements that extend longitudinally of the back shell. The stiffening elements can extend a major portion of the distance between the top and bottom of the back shell.

According to another embodiment, a chair for patient treatment having a chair back which may be reclined to place a patient in a generally supine position comprises an elongate support member, a back shell, and a cushion adjoining the back shell. The elongate support member has a proximal end, a distal end and a front surface, the member being configured for connection at its proximal end to a mechanism on the chair allowing the member to be moved from a generally upright position to a position tilted rearwardly therefrom. The back shell has a front surface, a back surface, a top, a bottom, opposed first and second outer sides, a central section extending longitudinally from a region adjacent the top to a region adjacent the bottom and opposed side sections extending laterally outwardly from the central section toward the first and second outer sides, wherein the central section comprises a plurality of stiffening elements that extend longitudinally of the back shell.

The chair can comprise a headrest movably coupled to the chair back adjacent the top of the back shell, the headrest being selectively raiseable and lowerable relative to the top. The top of the back shell can have opposed top margin portions positioned to provide support for a patient's scapula and a center top section between the top margin portions that is cut away to permit positioning of the headrest in a region between the opposed top margin portions.

According to another embodiment, a chair for patient treatment having a chair back which may be reclined to place a patient in a generally supine position, comprises an elongate support member, a back shell, a cushion adjoining the back shell, and a headrest and headrest stem. The elongate support member has a proximal end, a distal end and a front surface. The elongate support member is configured for connection at its proximal end to a mechanism on the chair allowing the column to be moved from a generally upright position to a position tilted rearwardly therefrom. The back shell has a front surface, a back surface, a top, a bottom, opposed first and second outer sides, a central section extending longitudinally from a region adjacent the top to a region adjacent the bottom and opposed side sections extending laterally outwardly from the central section toward the first and second outer sides, the bottom being connected to the distal end of the elongate support column. The headrest stem is movably coupled to the back shell and can be retracted to position the headrest in overlapping relation or in contact with the top of the back shell.

The top of the back shell can have opposed top margin portions positioned to provide support for a patient's scapula and a center top section between the top margin portions which is depressed to permit positioning of the headrest in the region between the opposed top margin portions.

The foregoing and additional features and advantages will be more readily apparent from the following detailed description, which proceeds with reference to the accompanying drawings.

BRIEF DESCRIPTION OF THE DRAWINGS

FIG. 5 is an enlarged front elevation view of a back shell forming a portion of the chair;

FIG. 6 is a side elevation view taken generally along the line 6-6 in FIG. 5;

FIG. 7 is a rear view taken along the line 7-7 in FIG. 6 of a central section of the back shell;

FIG. 7A is a cross-sectional view taken generally along the line 7A-7A in FIG. 7;

FIGS. 8, 9 and 10 are cross-sectional views taken generally along the lines 8-8, 9-9 and 10-10, respectively, in FIG. 5;

FIG. 11 is a schematic illustrative view of a method for forming an upholstery cover for the device; and FIG. 12 is an enlarged view of an edge margin portion of the assembled chair back.

DETAILED DESCRIPTION

Figure 1:
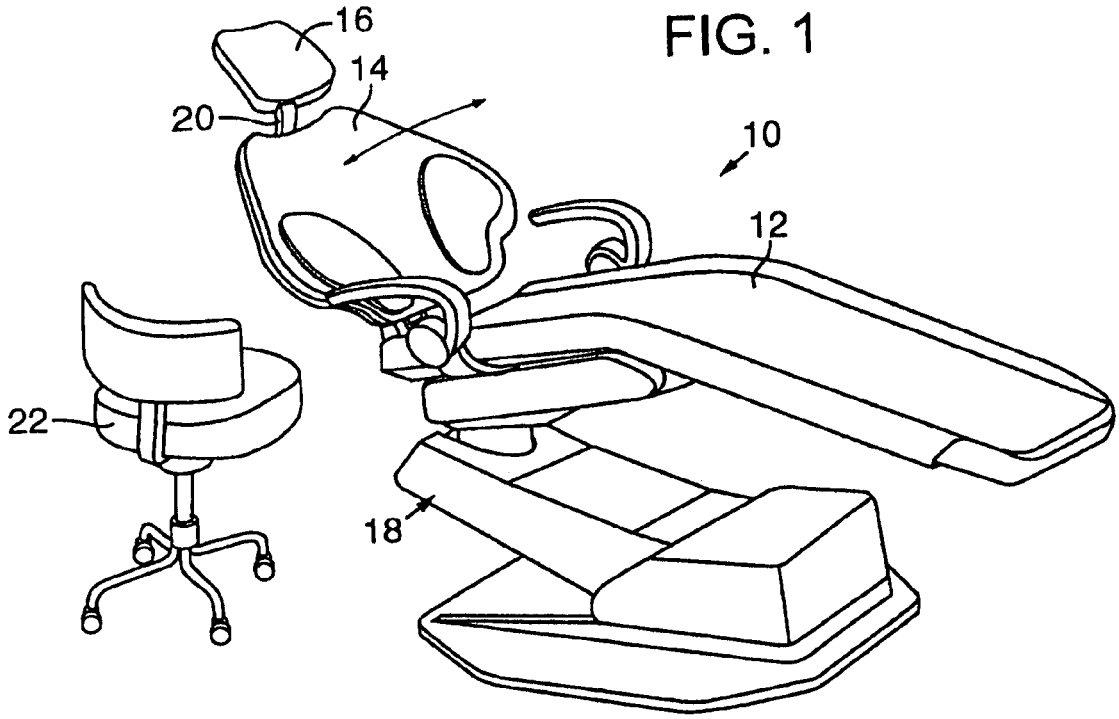
FIG. 1 is a perspective view of a patient's chair having a back according to one embodiment.
Figure 2:
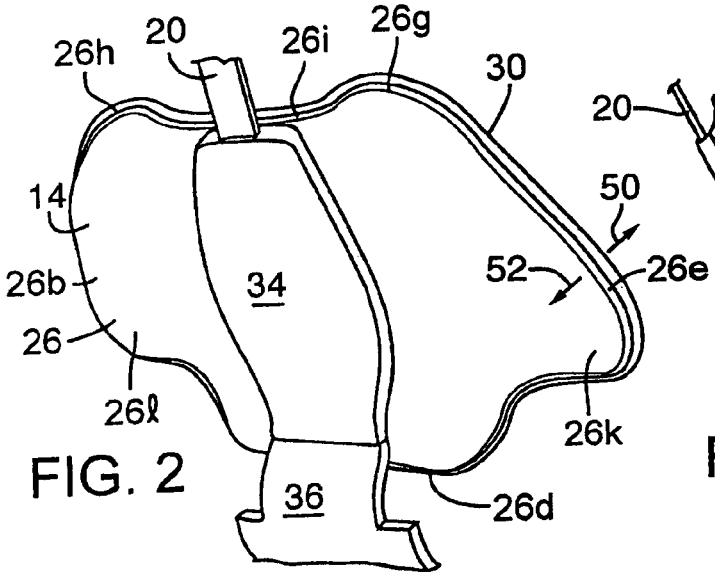
FIG. 2 is an enlarged rear perspective view of the chair back.
Figure 3:
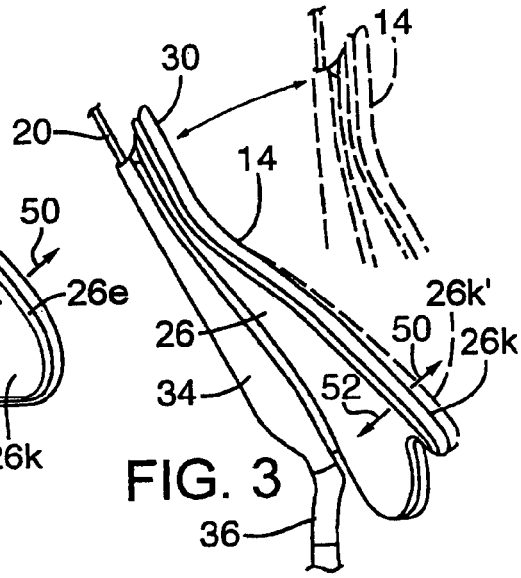
FIG. 3 is a side elevation view of the chair back.

Referring to the drawings, and first more specifically to FIG. 1, at 10 is indicated generally a patient chair, and more particularly, a dentist chair in which a patient would be supported during an operation or treatment. The chair includes a seat 12, back 14, headrest 16, and operating mechanism 18. The operating mechanism is capable of raising and lowering the chair and tilting the chair back from a substantially upright position, as shown in dashed out line in FIG. 3, to a more reclining, or supine, position as illustrated in FIGS. 1 and 3 in which the patient is in generally a laid back, or supine, position. The chair back actually may be tilted back farther than illustrated in FIGS. 1 and 3. The headrest 16 is mounted on a stem 20 which permits it to be slid up and down, toward and away from the top of back 14.

Also illustrated in FIG. 1 is an operator's stool 22 on which a dentist or dentist's assistant (the operator) would be seated adjacent chair 10. The operator would be seated such that their knees would be adjacent or under one side section of back 14 and upon lowering of the chair back to a convenient operator's position, the side section of the chair back may actually engage and press down a bit on the lap of the operator. This is to place the patient in a position which is as low as possible relative to the operator's lap to provide a more convenient and effective working position for the operator.

Figure 4:
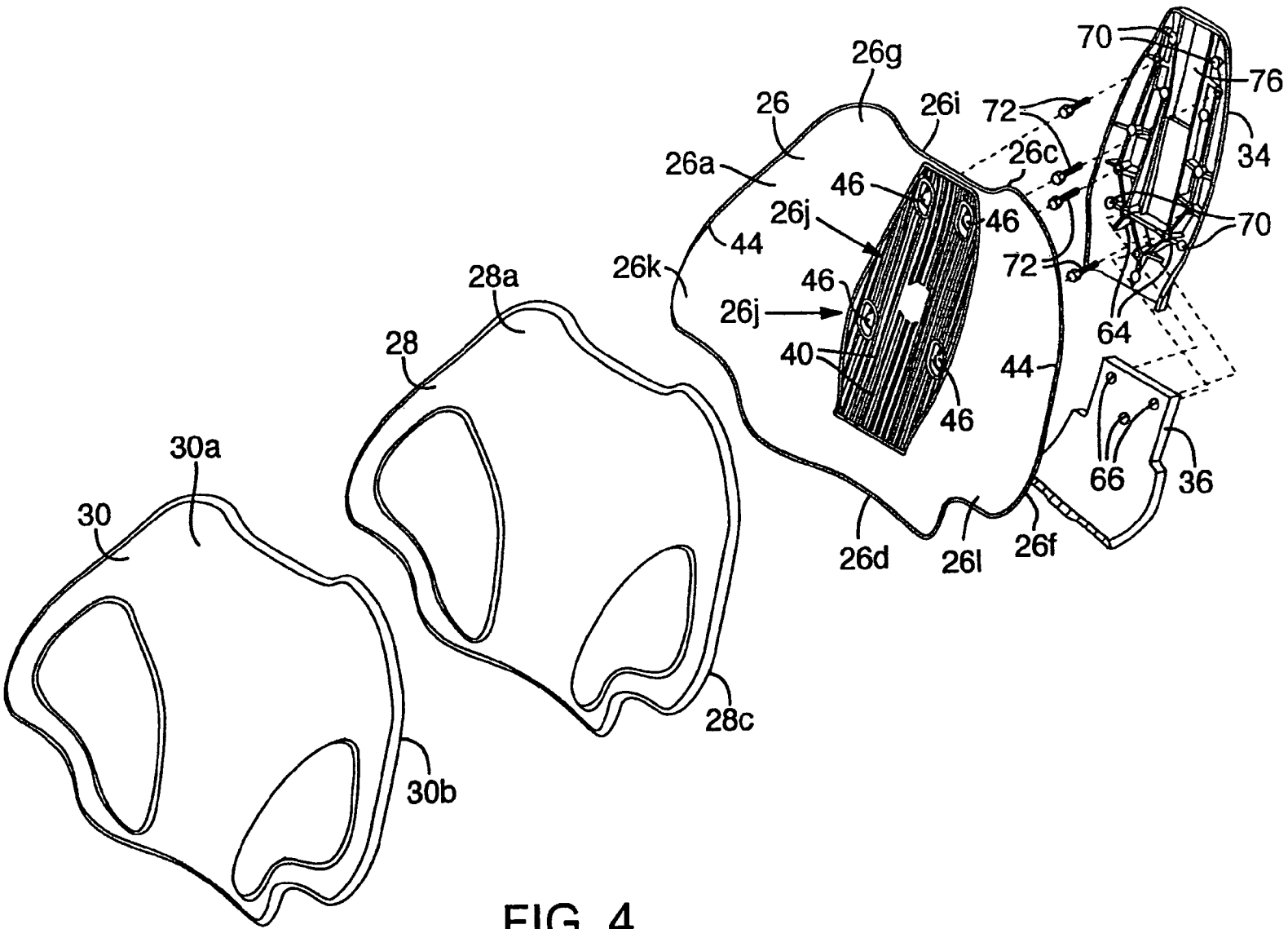
FIG. 4 is an exploded view of the component parts of the chair back and support therefore.

Referring to FIG. 4, the chair back includes three primary components. These are a back shell 26, a cushion layer 28, and an upholstery layer 30. The back is removably mounted on a support column 34 and the support column, in turn, is secured to a tilting arm 36 which is attached to and operated by the operating mechanism 18 of the chair to tilt, or rotate, the chair back between its upright and reclining positions.

Referring to FIGS. 5-10, the back shell 26 in the illustrated embodiment is a relatively thin molded plastic member having a front surface 26*a*, back surface 26*b*, top 26*c*, bottom 26*d*, and opposed outer sides 26*e*, 26*f*. The outer peripheral edge of the back shell has a selected outline as illustrated generally in FIG. 5.

The back shell has opposed top margin portions 26*g*, 26*h* which in the assembled product are high enough to comfortably support a patient's scapula. The center top section 26*i*, between top margin portions 26*g*, 26*h*, is depressed and has a width sufficient to receive headrest 16 therein so that the headrest may be lowered to a position close enough to the back to comfortably support a patient's head.

Explaining further, the chair back is designed to provide good support for patients in a wide range of heights and sizes. The scapula support region adjacent top margin portions 26*g*, 26*h* must be high enough on the back to align with the scapula region of a very tall patient. At the same time, the headrest must be allowed to be lowered sufficiently to align with the head of a very short patient. Thus the high scapula support regions adjacent top margin portions 26*g*, 26*h* provide scapula support for tall patients, while the depressed center top section 26*i* permits the headrest to be lowered to a position which will provide comfortable headrest for a short patient.

The back shell has a substantially rigid central section 26*j*. A plurality of substantially parallel elongate strengthening ribs 40 extend from a region adjacent the top of the back shell to a region adjacent the bottom of the back shell in central section 26*j*.

As seen in side view in FIG. 6, and in cross-section in FIG. 7A, the central, or median, portion of the back shell has a shallow gentle S-shaped configuration extending from top to bottom. This is to provide a comfortable configuration for supporting a user in the chair.

The back shell also has opposed side, or wing, sections 26*k*, 26*l* which extend laterally outwardly to opposite sides of central section 26*j* and are positioned to support a patient's arms when placed in a reclining position.

As viewed in section, as illustrated in FIGS. 8, 9 and 10, it will be seen that the back shell is substantially straight across near the top of the back shell (FIG. 8) and a short distance therebelow begins to curve into a shallow concave curvature on its front surface (as shown in FIG. 9).

In a region generally beginning at the mid-region of the chair and progressing downwardly therefrom, the back shell assumes a generally trough shaped configuration as illustrated in FIG. 10. The trough shaped portion of the chair back is contoured to comfortably receive a patient's back. Side sections 26*k*, 26*l* extend laterally outwardly in a substantially common plane disposed forwardly of the trough shaped center section and lie in a plane which is substantially perpendicular to the center line of the back shell.

The back shell preferably is formed as a one piece sheet-like member, such as by being molded from a synthetic resin material, preferably plastic, having desired properties of rigidity, elasticity and resiliency as required for the functions needed herein. The back shell preferably will be of relatively thin, but substantially uniform thickness throughout over a major portion of the back shell. In a preferred embodiment, the back shell is a broad functionally sculpted injection molded part which may be made of Valox 364 from General Electric averaging in a range of from 0.135 to 0.190 inch thick, preferably about 0.187 inch, to obtain the desired thinness and flexibility.

Extending fully about the peripheral outer edge of the back shell is a raised rim 44. The rim projects forwardly from the front surface 26*a* of the back shell a distance X as illustrated in FIG. 12. This distance X may be in a range of from 0.07 to 0.09 inch.

Formed into the backside of shell 26 are a plurality of keyhole-shaped receiving notches for receiving headed fasteners on support column 34, as will be described in greater detail below.

As previously discussed, the central section 26*j* is substantially rigid and has a shallow S-shaped configuration for providing substantial support for a patient's back. Side sections 26*k*, 26*l* are sufficiently flexible and resilient to allow deflection of a side section in the direction of the front surface from a selected normal position by application of force imposed on the side section and to return the side section to the normal position on release of such force. This is possibly best illustrated in FIG. 3. The back shell and its associated cushion and upholstery layers are shown in solid outline in FIG. 3 in what would be considered their normal, or at rest, position. The side sections (26*k* shown here) are flexible fore and aft, as illustrated by arrows 50, 52, when a force is imposed on the side section in one direction. Upon release of such force, the side section will return to its normal, at rest, position.

In use, when the chair back is pivoted to its reclined position and a side section may come into contact with an operator's leg, or lap, a force thus will be imposed on the side section in the direction of arrow 50 causing it to deflect forwardly to a position as illustrated in dashed outline at 26*k*' to permit the patient to be placed in the most convenient orientation for the operator and yet not to impose an uncomfortable force on the operator's legs.

As shown in FIG. 5, the central section of the back shell has a width indicated generally at W1 and has an overall width indicated at W2. W2 generally would be in excess of two times W1. As an example of the flexibility of side sections 26*k* and 26*l*, the back shell has sufficient flexibility that a side section, such as 26*k*, may be flexed forwardly in the direction of arrow 50, a distance of about 0.5 inch by an imposed force of 30 pounds.

The front, or face, surface 26*a* of back shell 26 has a selected topographic contour as shown in the figures.

Cushion 28, which is a layer of resilient material, is a preformed molded product. It is preformed to have a back surface topographic contour generally complementary to the topographic contour of the front surface 26*a* of the back shell so it will rest closely thereagainst. Cushion 28 also has a front surface topographic contour configured to provide comfortable support for a user. The front surface is indicated generally at 28*a* and the back surface at 28*b*. The cushion has an outer edge margin 28*c* with a peripheral edge configuration substantially parallel to the outer peripheral edge configuration outline of back shell 26, but slightly larger than the outline of the back shell. The dimensions of the cushion are such that the cushion material, when applied to the back shell, extends radially outwardly from all of the outer peripheral edges of the back shell by a distance Y as illustrated generally in FIG. 12. This distance Y may be in a range of from 0.25 to 0.5 inch, and more preferably in the illustrated embodiment at 0.5 inch.

The upholstery covering 30 may be of a relatively thin vinyl or upholstery shell material preformed to conform to the topographic contour configuration of front, or face, surface 28*a* of the cushion material. The upholstery layer has a face portion 30*a* and an edge margin portion 30*b* which is turned back to provide a portion 30*c* which may engage the backside 28*b* of cushion 28. The width of edge margin portion 30*c* is indicated at "Z" in FIG. 12, and may be in a range of about 0.5 to 4.0 inches.

The upholstery layer may be preformed of a vinyl material to have the general configuration illustrated in FIGS. 4 and 12. This preformed configuration may be provided by a method illustrated in FIG. 11. Here it is shown that a mold form 56 has a face surface 56*a* and outer edge portions 56*b* which conform generally to the configuration of cushion 28 on which the upholstery material is to be applied. The vinyl material is heated to soften such, then draped over mold form 56, and a vacuum is drawn through mold form 56 to cause material 30 to be drawn tightly against the form. The vinyl then is allowed to cool and set in the general configuration illustrated. The material is cut along lines 48 to produce rear margin portions 30*c* and waste portions 30*d* are cut therefrom and discarded.

The chair back is assembled by applying adhesive either to the front surface 28*a* of the cushion material and its edge margin portions 28*c*, or to all of the interior surfaces of upholstery material 30 which will engage cushion layer 28, or to both upholstery and cushion layer. The cushion layer then is inserted into the preformed upholstery material layer and adhered thereto about all of the inner surfaces of portions 30*a*, 30*b*, and 30*c* of the upholstery material which face the cushion as illustrated in FIG. 12. An example of the adhesive used may be a contact adhesive.

Adhesive then is applied either to the rearwardly facing surfaces of marginal edge portions 30*c* of the upholstery material which face the front surface 26*a* of the back shell or to the surface of the back shell which will be engaged by portion 30*c* of the upholstery material. The combination cushion and upholstery layers then are pressed against the back shell to glue the assembly together in the region of marginal edge portions 30*c* of the upholstery material. The adhesive or glue used may be cyanoacrylate. As the parts are pressed together for gluing as illustrated in FIG. 12, rim 44 acts to prevent excess glue from escaping from the confines of the back shell.

The construction of the back as described allows it to consist of the back shell, cushion layer, and upholstery material only. This eliminates the need for an armature, which previously has been used, thus allowing the back to be made much thinner and providing better access for the operator in working on the patient.

Referring again to FIG. 4, support column 34 is a formed substantially rigid member having an outline configuration generally similar to the configuration of the central section of back shell 26. The support column has a face directed toward the back shell, a back directed away therefrom, a lower, or proximal, end, an upper, or distal, end and opposed elongate side edges. The lower, or proximal, portion of support column 34 is adapted to receive an upper portion of tilting arm 36 and has threaded bores 64 formed therein. Tilting arm 36 has bores 66 extending therethrough through which threaded fasteners may extend to be received in bores 64 on the support column 34 to secure the support column to the tilting arm and operating mechanism of the chair.

The support column also has four additional threaded bores 70 adapted to receive headed fasteners 72. The headed fasteners may be screws or bolts which are screwed into bores 70 with their heads projecting outwardly therefrom. With the support column securely mounted on tilting arm 36 and headed fasteners 72 received in bores 70, the back 14 may be easily and removably mounted thereon on support 34. This is done by placing keyhole-shaped receiving notches 46 over the heads of fasteners 72 and sliding the back downwardly to engage the headed fasteners in the reduced section portions of notches 46.

The support column also has an elongate upright channel 76 formed therein which is adapted to receive stem 20 on the headrest 16. Appropriate mechanism would be provided in the channel for permitting positioning of the headrest as desired.

While a preferred embodiment has been described herein, it should be apparent to those skilled in the art that variations and modifications are possible without departing from the spirit and scope of the invention as set forth in the claims.

What is claimed:

1. A back for a patient chair with which a patient may be moved from a generally upright sitting position to a generally supine position, the back comprising:

a back shell having a front surface, a back surface, a top, a bottom, opposed first and second outer sides, a central section extending longitudinally from a region adjacent the top to a region adjacent the bottom and opposed side sections extending laterally outwardly from the central section toward the first and second outer sides and occupying a substantially common plane; and a cushion attached to the back shell;

wherein the region adjacent the bottom of the back shell defines a trough shared portion, the substantially common plane is disposed forwardly of the trough shaped portion and the opposed side sections are deflectable in each direction along an axis extending normal to the substantially common plane so as to resiliently support at least the arms of patients of different sizes when occupying the chair in a generally supine position.

2. The back of claim 1, wherein the side sections have sufficient flexural stiffness to support portions of a patient in a supine position and to allow deflection from a selected at rest position of a side section in a direction of a force component applied substantially perpendicular to the front surface by application of the force component on the side section and to return the side section to the normal position on release of such force.

3. The back of claim 1, wherein the back shell is comprised of molded plastic having a flexibility in a side section such that the side section may be flexed a distance of about 0.5 inch by a force of about 30 pounds imposed thereon.

4. The back of claim 1, wherein the central section is formed in a gentle S-shape to conform generally to a patient's spine.

5. The back of claim 1, wherein the central section comprises a plurality of stiffening elements extending a major portion of the distance between the top and bottom of the back shell.

6. The back of claim 1, further comprising:

opposing first and second scapula support sections adjacent the top; and a depressed center top-section adjacent the top and disposed between the scapula support sections, where the top-section is configured to allow positioning of a portion of a headrest between the scapula support sections.

7. The back of claim 1, wherein the back shell has an outer peripheral edge of a selected outline, and the cushion comprises:

a resilient cushion material, an outer edge margin contour substantially paralleling the outer peripheral edge of the back shell, and a layer of upholstery material overlying the cushion material.

8. The back of claim 1, wherein the front surface of the back shell has a selected topographic contour and the cushion material is pre-formed to substantially complement the topographic contour.

9. The back of claim 8, wherein the upholstery material is pre-formed to complement the shape of the front surface and the outer marginal edge of the cushion material.

10. The back of claim 1, wherein the substantially common plane is substantially perpendicular to a longitudinal midplane of the back shell when the back shell is in an at-rest position.

11. The back of claim 1, wherein the opposed side sections occupy the substantially common plane in at least an at-rest position.

12. A back for a patient chair with which a patient may be moved from a generally upright sitting position to a generally supine position, the back comprising:

a back shell having a front surface, a back surface, a top, a bottom, opposed first and second outer sides, a central section extending longitudinally from a region adjacent the top to a region adjacent the bottom, opposed side sections extending laterally outwardly from the central section toward the first and second outer sides and occupying a substantially common plane, and opposing first and second scapula support extension sections adjacent and extending longitudinally beyond adjacent portions of the top;

a headrest receiving area defined by each of the first and second scapula support extension sections and a depressed portion of the top between the scapula support extension sections, the headrest receiving area being configured to receive a headrest retractably mounted to the back when the headrest is retracted into a retracted position with a lower edge of the headrest contacting or overlapping the depressed portion of the top; and a cushion adjoining the back shell wherein the central section is substantially rigid along a longitudinal direction and the scapula support extension sections are deflectable in both directions of an axis extending normal to the opposed side sections, wherein the region adjacent the bottom of the back shell defines a trough shaved portion and the substantially common plane is disposed forwardly of the trough shaved portion so as to flexibly support shoulder portions of different-sized patients forwardly of the patient's back when occupying the chair in a supine position.

13. The back of claim 12, wherein the central section is formed in a gentle S-shape to conform generally to a patient's spine.

14. The back of claim 12, further comprising a plurality of stiffening elements that extend longitudinally of the back shell.

15. The back of claim 14, wherein the stiffening elements extend a major portion of the distance between the top and bottom of the back shell.

16. The back of claim 12, wherein the opposed side sections occupy the substantially common plane in at least an at-rest position.

17. A chair for patient treatment having a chair back which may be reclined to place a patient in a generally supine position, the chair comprising:

a substantially rigid elongate support member having a proximal end, a distal end and a front surface, the member being configured for connection at its proximal end to a mechanism on the chair allowing the member to be moved from a generally upright position to a position tilted rearwardly therefrom;

a back shell having a front surface, a back surface, a top, a bottom, opposed first and second outer sides, a central section secured to the substantially rigid elongate support member and extending longitudinally from a region adjacent the top to a region adjacent the bottom and opposed side sections extending laterally outwardly from the central section toward the first and second outer sides and occupying a substantially common plane, the region adjacent the bottom of the back shell defining a trough shaped portion, the substantially common plane being disposed forwardly of the trough shared portion and the opposed side sections being deflectable in both directions along an axis normal to the opposed side sections so as to resiliently support one or more respective portions of different sized patients forwardly of the patient's back when occupying the chair in a generally supine position; and a cushion adjoining the back shell.

18. The chair of claim 17, wherein the central section comprises a plurality of stiffening elements that extend longitudinally of the back shell and a major portion of the distance between the top and bottom of the back shell.

19. The chair of claim 17, wherein the cushion forms a back surface generally complementary to the topographic contour of the front surface of the back shell.

20. The chair of claim 17, wherein the upholstery material is preformed to the shape of the face surface and the outer marginal edge of the cushion material.

21. The chair of claim 17, further comprising:

a headrest movably coupled to the chair back adjacent the top of the back shell, the headrest being selectively raiseable and lowerable relative to the top, wherein the top of the back shell has opposed top margin portions positioned to provide support for a patient's scapula and a center top section between the top margin portions that is cut away to permit positioning of the headrest in a region between the opposed top margin portions.

22. A chair for patient treatment having a chair back which may be reclined to place a patient in a generally supine position, the chair comprising:

an elongate support member having a proximal end, a distal end and a front surface, the member being configured for connection at its proximal end to a mechanism on the chair allowing the column to be moved from a generally upright position to a position tilted rearwardly therefrom;

a back shell having a front surface, a back surface, a top, a bottom, opposed first and second outer sides, a central section extending longitudinally from a region adjacent the top to a region adjacent the bottom and being substantially rigid, the region adjacent the bottom defining a trough shaped portion, and opposed side sections extending laterally outwardly from the central section toward the first and second outer sides and occupying a substantially common plane disposed forwardly of the trough shared portion, the side sections being substantially deflectable and having sufficient flexural resiliency along an axis normal to the side sections in an at-rest position so as to resiliently support different-sized patients in each of a plurality of supine positions, the bottom being connected to the distal end of the elongate support column;

a cushion adjoining the back shell; and a headrest and headrest stem, the headrest stem being movably coupled relative to the back shell, wherein the headrest stem can be retracted to position the headrest in overlapping relation or in contact with the top of the back shell.

23. The chair of claim 22, wherein the top of the back shell has opposed top margin portions positioned to provide support for a patient's scapula and a center top section between the top margin portions which is depressed to permit positioning of the headrest in the region between the opposed top margin portions.

* * * * *

UNITED STATES PATENT AND TRADEMARK OFFICE

CERTIFICATE OF CORRECTION

PATENT NO. : 7,677,670 B2
APPLICATION NO. : 11/982891
DATED : March 16, 2010
INVENTOR(S) : Carl G. Nordstrom et al.

It is certified that error appears in the above-identified patent and that said Letters Patent is hereby corrected as shown below:

Column 7, line 56, claim 1 delete "trough shared portion," and insert --trough shaped portion,--.

Column 9, line 4, claim 12 delete "shaved portion" and insert --shaped portion--.

Column 9, line 5, claim 12 delete "trough shaved portion" and insert --trough shaped portion--.

Column 9, line 40, claim 17 delete "trough shared portion" and insert --trough shaped portion--.

Column 10, line 33, claim 22 delete "trough shared portion," and insert --trough shaped portion,--.

Signed and Sealed this

Seventeenth Day of August, 2010

David J. Kappos

David J. Kappos
*Director of the United States Patent and Trademark Office*